United States Patent [19]

Firey

[11] Patent Number: 4,889,539

[45] Date of Patent: Dec. 26, 1989

[54] STEADY WORK OUTPUT RATE APPARATUS FOR CYCLIC SOLID WITH GAS REACTORS

[76] Inventor: Joseph C. Firey, P.O. Box 15514, Seattle, Wash. 98115-0514

[21] Appl. No.: 349,526

[22] Filed: May 9, 1989

Related U.S. Application Data

[63] Continuation-in-part of Ser. No. 279,785, Dec. 5, 1988, abandoned.

[51] Int. Cl.[4] ..... C10J 3/00; C10J 3/22

[52] U.S. Cl. ..... 48/61; 60/39.12; 60/39.17; 422/110; 422/111

[58] Field of Search ..... 48/61, 63, 64, 76, 77, 48/86 R, 87, DIG. 6, 197 R, 203, 40; 60/39.12, 39.17; 123/1 R, 3, 23, 25 R, 64; 422/110, 111, 116, 234, 235

[56] References Cited

U.S. PATENT DOCUMENTS 1,913,968 6/1933 Winkley ..... 48/203
4,085,578 4/1978 Kydd ..... 60/39.12
4,455,837 6/1984 Firey ..... 60/670
4,509,957 4/1985 Firey ..... 48/DIG. 6

*Primary Examiner*—Peter Kratz

[57] ABSTRACT

The use of pressure regulating values and tanks on compressor outlets and expander inlets of cyclic solid with gas reaction plants is described, together with the use of separate changeable gas flow passages and connection places into the reaction chambers from separate compressor and expander.

With thee pressure regulating values and tanks the net rate of work of a cyclic solid with gas reaction plant need not fluctuate and can be held steady.

With these separate gas flow passages the flow of reactant gas into the solid reactant during compression will be different in place from the flow of reacted gas out of the solid reactant during expansion. These differences of gas flow place can be useful for securing complete reaction of the solid reactant and for preventing carry-over of soaid materials into the expander.

3 Claims, 3 Drawing Sheets

STEADY WORK OUTPUT RATE APPARATUS FOR CYCLIC SOLID WITH GAS REACTORS

CROSS REFERENCES TO RELATED APPLICATIONS

This application is a continuation in part of my earlier filed U.S. patent application entitled "Multiple Changeable Gas Flow Connections Places Cyclic Solid With Gas Reactors" Ser. No. 07/279785, filed 5 Dec., 1988 and now abandoned.

The invention described herein is usable on the solid with gas chemical reactor machines described in my U.S. patent applications entitled, "Multiple Flow Passages With Differing Connection Places For Cyclic Solid With Gas Reactors", Ser. No. 07/2360, filed 23 Nov., 1988 and "Reactant Gas Reservoirs For Cyclic Solid With Gas Reactors", Ser. No. 07/242422, filed 9 Sept., 1988now U.S. Pat. No. 4,865,623

The invention described herein was previously described in part in my Disclosure Document number 196869, entitled, "Multiple Changeable Gas Flow Connections For Cyclic Gas With Solid Reactors".

BACKGROUND OF THE INVENTION

1. Field of the Invention

This invention is in the field of chemical reactor machines for reacting one or more porous solid reactants with one or more gaseous reactants, wherein compression of gaseous reactants into the pore spaces of the solid reactant is followed by expansion of the resultant product gases out of these pore spaces, and this cycle of compression and expansion is repeated.

2. Description of the Prior Art

Examples of prior art reactors for reacting solid reactants with gaseous reactants are described in the following U.S. patents:

U.S. Pat. No. 4,455,837, J. C. Firey, 26 Jun. 1984
U.S. Pat. No. 4,484,531, J. C. Firey, 27 Nov. 1984
U.S. Pat. No. 4,509,957, J. C. Firey, 9 Apr. 1985
U.S. Pat. No. 4,533,362, J. C. Firey. 7 Aug. 1985
U.S. Pat. No. 4,537,603, J. C. Firey, 27 Aug. 1985
U.S. Pat. No. 4,568,361, J. C. Firey, 4 Feb. 1986
U.S. Pat. No. 4,794,729, J. C. Firey, 3 Jan. 1989
U.S. Pat. No. 4,584,970, J. C. Firey, 29 Apr. 1986
U.S. Pat. No. 4,692,171, J. C. Firey, 8 Sept. 1987
U.S. Pat. No. 4,698,069, J. C. Firey, 6 Oct. 1987
U.S. Pat. No. 4,707,991, J. C. Firey, 24 Nov. 1987

In all of the above example reactors the gaseous reactants are compressed into the pore spaces of the solid reactants located within a reaction chamber inside a pressure vessel container, and this compression is followed by expansion of the primary reacted gases, formed by reaction of reactant gases with solid reactants, out of the pore spaces of the solid reactant. This cycle of compression followed by expansion is repeated. In some of these example gas with solid reactors fresh gaseous reactant is supplied for each compression and product reacted gases are removed during or after each expansion. In other of these example gas with solid reactors several cycles of compression and expansion are applied to a particular gas mass before removing product reacted gases and replacing with fresh reactant gas for the next sequence of cycles of compression and expansion.

Where a reciprocating piston is operated within a cylinder for both compressing and expanding the gases only a single stage of compression and expansion occurs and this is a combined means for compressing and expanding the gases. Where several stages of compression or where several stages of expansion are to be used the means for compressing the gases needs to be separate from the means for expanding the gases. Such separate compressors and separate expanders are herein and in the claims referred to as separate means for compressing and separate means for expanding, even when only one stage is used. The particular definition of a stage of a compressor or an expander is used herein and in the claims to be a portion of said compressor or expander which has a gas flow inlet and a gas flow outlet both of which make connections external from the compressor or expander.

Some means for driving the separate compressor is needed and this can be the separate expander, if an expander engine is used, or some other type of drive engine can be utilized. The net work output rate of a cyclic gas with solid reaction plant is herein defined as the difference between the work output rate of the expander engine and the work input rate to the compressor.

Such chemical reactors for reacting solids with gases and using this cyclic compression and expansion process are herein and in the claims referred to as cyclic gas with solid reaction plants. The descriptions of various such cyclic gas with solid reaction plants contained in the above listed U.S. Patents are incorporated herein by reference thereto.

The term solid reactant is used herein and in the claims to include wholly solid materials as well as solids whose surface is wetted with a liquid. A single solid reactant can be but a single chemical or a mixture of several different chemicals.

The term gas reactant is used herein and in the claims to include single gaseous chemicals as well as mixtures of several different gaseous chemicals which are about to be reacted with a solid reactant.

The term reacted gas is used herein and in the claims to include single gases or mixtures of different gases which have reacted with a solid reactant.

The term changeable gas flow connection is used herein and in the claims to mean a gas flow connection which can be opened or closed while the plant is operating. The term fixed open gas flow connection is used herein and in the claims to mean a gas flow connection which remains open whenever the plant is operating.

In many cyclic solid with gas reaction plants at least two steps of chemical reaction occur: a primary reaction between gas reactant and solid reactant during compression; a secondary reaction between the primary product reacted gas from the primary reaction and additional gas reactant during expansion. The primary reaction takes place principally with the pore spaces of the solid reactant whereas the secondary reaction takes place principally outside the pore spaces of the solid reactant. A volume or space wherein chemical reaction occurs is herein and in the claims referred to as a reaction chamber. For example, the pore spaces within the solid reactant are a primary reaction chamber, whereas any gas space outside this primary reaction chamber may be a secondary reaction chamber if secondary reactions occur there. These primary and secondary reaction chambers may be separately enclosed by the containing walls of separate pressure vessel containers or may be jointly enclosed within the containing walls of a single pressure vessel container.

Where separate compressor and separate expander are used and these perhaps each of several stages, several containers are used whose number at least equals the sum of the number of compressor stages plus the number of expander stages. Each of these several containers is connected in sequence to each outlet of each compressor stage in order of increasing reactant gas pressure and then to each inlet of each expander stage in order of decreasing reacted gas pressure and this sequence of changeable gas flow connections is repeated by each container for each cycle of compression followed by expansion. In this way each compressor outlet and each expander inlet is always connected to one container and each container is always connected to either one compressor outlet or one expander inlet or is undergoing replacement or removal of solid reactant.

In a cyclic velox boiler, as described in U.S. Pat. No. 4,455,837, it is desired to achieve complete burnup of the solid char fuel reactant, contained within the primary reaction chamber. For this complete burnup purpose admission of air, as reactant gas, into the primary reaction chamber during compression is preferably distributed along the length of the primary chamber from the char fuel admission end to the ash removal end. Ash retention within the primary reaction chamber is also desired so that ashes can be removed periodically from the ash removal end. For this ash retention purpose outflow of primary reacted gas from the primary reaction chamber during expansion is preferably only from the char fuel admission end where the char fuel particles are larger and heavier. But the ash particles are smaller than the char fuel particles. Hence, if combined air inflow and gas outflow channels are provided near the ash removal end to secure complete char fuel burnup, the reverse flow of primary reacted gas through these same channels during expansion may carry over ash particles into the expander. This is one example of a problem which the devices of the invention described herein can alleviate.

In a cyclic velox boiler, as described in U.S. Pat. No. 4,455,837 for example, and in a cyclic char gasifier, as described in U.S. Pat. No. 4,509,957 for example, wherein the expander is an engine and is used to drive the compressor, at least in part, the net rate of work output fluctuates at each change of connections of the changeable gas flow connections. This fluctuation of net work output results primarily from the changes of container pressures during each time interval between changes of connections, the pressure in containers being compressed rising during the interval, while the pressure in containers being expanded decreasing during the interval. A description of these fluctuations of net work output is presented in my U.S. Pat. No. 4,509,957 at column 26, lines 27 through 53 and column 38, lines 25 through 51, and this material is incorporated herein by reference thereto. It would be desirable to have cyclic velox boiler plants, cyclic char gasifier plants, and other cyclic solid with gas reaction plants, which did not suffer the disadvantage of these net work output fluctuations.

SUMMARY OF THE INVENTION

The pressure regulator and tank means for holding pressures steady at compressor stage outlets and at expander stage inlets of a cyclic solid with gas reaction plant with separate compressor and separate expander create a steady net rate of work for the plant. The rate of work fluctuations which would otherwise occur at each change of gas flow connections are thusly avoided and this is a principal beneficial object of this invention.

The changeable gas flow passages between the reaction chambers containing solid reactant and the separate compressor means are in this invention separate from the changeable gas flow passages between the reaction chambers and the separate expander means. Also these separate passages connect into the containers of these reaction chambers at different places. As a result the reactant gas flows into the reaction chamber containing solid reactant during compression at a different place from where the reacted gas flows out of this solid reactant containing chamber during expansion. By directing reactant gas flow during compression to the reaction chamber portion containing solid reactant longest reacted more complete reaction of the solid reactant prior to removal from the reaction chamber can be secured. By directing reacted gas flow during expansion to occur from the reaction chamber portion containing solid reactant least reacted, carryover of highly reacted solid into the expander can be avoided. This securing of complete reaction of solid reactant while avoiding solids carryover are among other beneficial objects of this invention.

DESCRIPTION OF THE PREFERRED EMBODIMENTS

Figure 1:
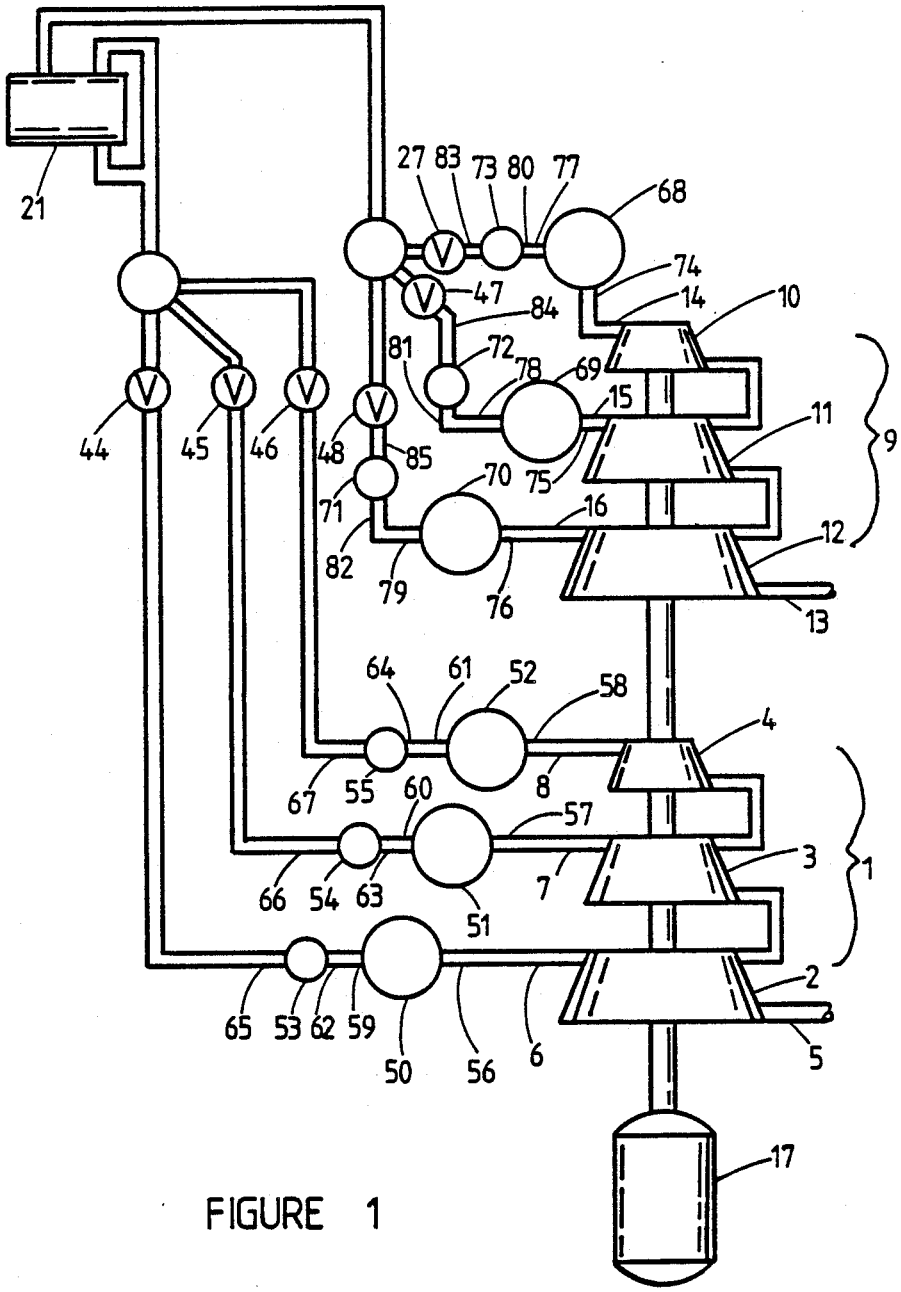
FIG. 1 is a schematic diagram of one particular form of this invention using multistage compressor and expander and showing instantaneous connections. The connections for one particular container are shown schematically in FIG. 2. An improved method for connecting into containers is shown in FIG. 3.

The steady work output rate apparatus of this invention is used with cyclic gas with solid reaction plants such as those described in the description of the prior art and in the cross references to related applications. All forms of this invention comprise the following elements:

(a) A cyclic gas with solid reactor plant comprising: a separate compressor means comprising at least one stage: a means for driving the compressor; a separate expander means comprising at least one stage; a number of pressure vessel containers at least equal to the sum of the number of compressor stages plus the number of expander stages, each container comprising at least one reaction chamber contained inside the pressure vessel and at least one of these reaction chambers is supplied with solid reactant; each compressor stage comprising an outlet pipe for gases being compressed therein; each expander stage comprising an inlet pipe for gases to be expanded therein; separate changeable gas flow connections between each container and each outlet of each stage of the compressor and each inlet of each stage of the expander.

(b) For each compressor stage a separate means for holding steady the discharge pressure of gas flowing from the compressor stage outlet is used and comprises: a tank for containing gas at high pressure and fitted with a tank inlet and a tank outlet; a back pressure regulating means, whose inlet is connected to the tank outlet so that gas flowing from tank inlet to tank outlet is regulated to an essentially steady pressure, and comprising a back pressure regulator outlet.

(c) Each of these means for holding steady discharge pressure is interconnected between the outlet pipe of one stage of the compressor and those changeable gas flow connections to which that one compressor stage delivers compressed gas. Each stage of the compressor is thusly fitted with one means for holding steady discharge pressure. With these interconnections all compressed gas from a compressor stage outlet flows into the tank, then through the back pressure regulating means, and then to that changeable gas flow connection which is currently open. Thus each back pressure regulating means acts to hold steady the discharge gas pressure in the tank and hence at the outlet of the connected compressor stage despite changes of pressure within that container currently being compressed by the connected compressor stage.

(d) For each expander stage a separate means for holding steady the inlet pressure of gas flowing to the expander stage inlet is used and comprises: a tank for containing gas at high pressure and fitted with a tank inlet and a tank outlet; a downstream pressure regulating means whose outlet is connected to the tank inlet so that gas flowing into the tank inlet is regulated to an essentially steady pressure, and comprising a downstream pressure regulator inlet.

(e) Each of these means for holding steady inlet pressure is interconnected between the inlet pipe of one stage of the expander and those changeable gas flow connections from which that one expander stage receives reacted gas. Each stage of the expander is thusly fitted with one means for holding steady inlet pressure. With these interconnections all reacted gas going to an expander stage flows from that changeable gas flow connection which is currently open, then into the downstream pressure regulating means, then into tanks, and then into the expander stage inlet. Thus each downstream pressure regulating means acts to hold steady the reacted gas pressure in the tank and hence at the inlet of the connected expander stage despite changes of pressure within that container currently being expanded through the connected expander stage.

In a cyclic gas with solid reaction plant thusly fitted with the steady work output apparatus of this invention, the discharge pressure at each compressor stage outlet remains steady and the inlet pressure to each expander stage inlet remains steady and hence the rate of net work output of the plant also remains steady. This is a principal beneficial object of this invention, to eliminate the fluctuations of net work output rate characteristic of cyclic gas with solid reaction plants not equipped with the devices of this invention.

So that the back pressure regulating means on each compressor stage outlet can operate as intended the compressor stage outlet pressure must equal or exceed the pressure within that container being compressed by that compressor stage during that time interval. When container pressure reaches compressor stage outlet pressure the time interval is to end and the changeable gas flow connections are changed to start the next following time interval. Similarly each expander stage inlet pressure must be equal to or less than the pressure within that container being expanded into that expander stage during that time interval so that the downstream pressure regulating means on each expander stage inlet can operate as intended. When container pressure reaches expander stage inlet pressure the time interval is to end and the changeable gas flow connections are changed to start the next following time interval. In consequence compressor discharge pressures exceed container pressures and expander inlet pressures are less than container pressures and the efficiency of net work output is reduced. This loss of work efficiency can be reduced by increasing the number of compressor stages and by increasing the number of expander stages. With a larger number of stages container pressure change during each time interval becomes smaller and hence the pressure difference across the pressure regulating means becomes smaller and less efficiency loss results.

Preferably a means for holding steady the discharge pressure is used at each compressor stage outlet and a means for holding steady the inlet pressure is used at each expander stage inlet. While it is possible to use such steady pressure holding means on only some, but not all, of the expander stages, or on only some but not all of the compressor stages the work rate fluctuations will then be only reduced and not eliminated.

The volume of the tanks to be used herein depends upon the sensitivity of the pressure regulating means to pressure changes in the container and the response time of the pressure regulating means to correct for these pressure changes. For a pressure regulating means of high sensitivity and short response time a small tank volume is adequate and a short length of pipe may alone be an adequate tank. For a pressure regulating means of lower sensitivity and longer response time a larger tank volume will be preferred.

Figure 2:
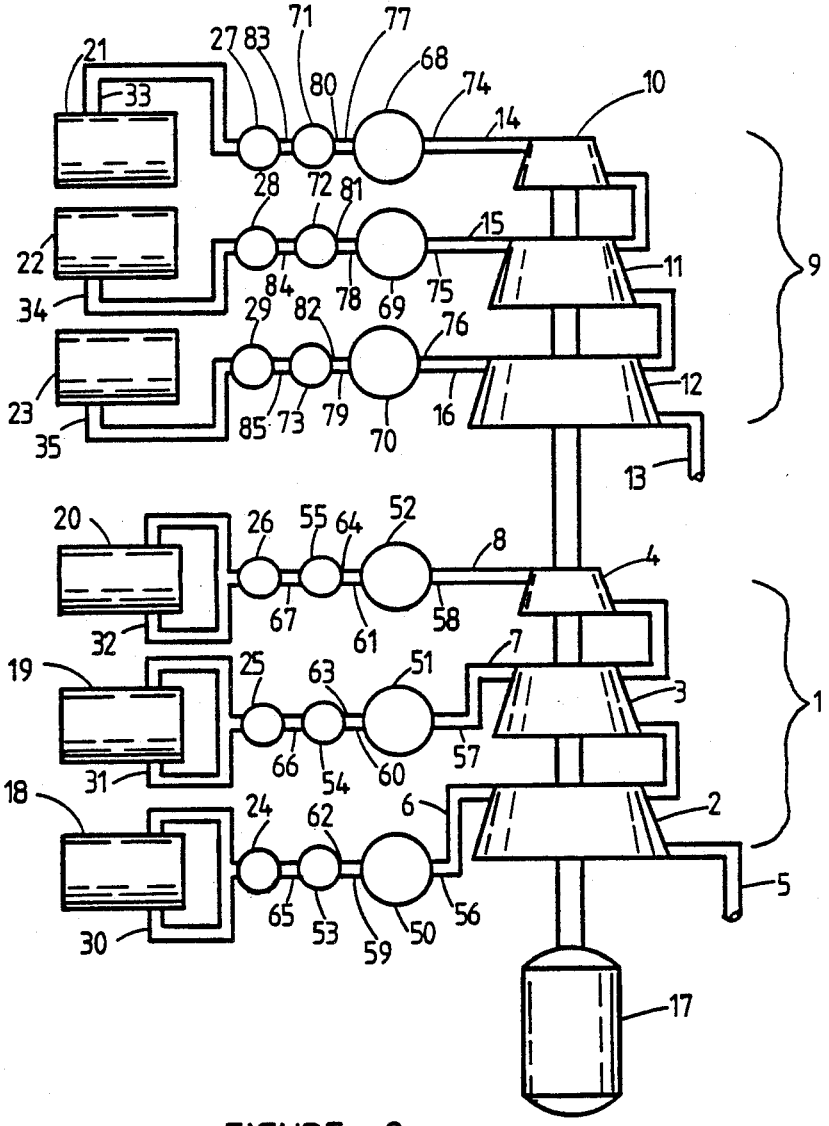

One example of a cyclic gas with solid reaction plant with steady work output rate apparatus of this invention is shown schematically in FIG. 1 and FIG. 2 and comprises the following elements:

A. A cyclic gas with solid reaction plant comprising:

1. A separate compressor, 1, comprising three stages, a low pressure stage, 2, an intermediate pressure stage, 3, and a high pressure stage, 4, connected in series to compress reactant gas from the low pressure compressor stage inlet at, 5, to higher pressures. The low pressure stage, 2, has an outlet, 6; the intermediate pressure stage, 3, has an outlet, 7, and the high pressure stage has an outlet, 8.
2. A separate expander, 9, comprising three stages, a high pressure stage, 10, an intermediate pressure stage, 11, and a low pressure stage, 12, connected in series to expand reacted gas down to the low pressure expander stage outlet at 13. The high pressure stage, 10, has an inlet, 14; the intermediate pressure stage, 11, has an inlet, 15, and the low pressure stage has an inlet, 16.
3. The compressor, 1, can be driven in whole or part by the expander, 9. A motor-generator unit, 17, can either supplement the expander, 9, power or absorb any excess of expander power output over compressor power input. Other methods of driving the compressor and absorbing the expander power can also be used.
4. At least six separate pressure vessel containers, 18, 19, 20, 21, 22, 23, each containing at least one reaction chamber containing solid reactant, are shown in FIG. 2 with container, 18, connected to the low pressure compressor stage outlet, 6, via the changeable gas flow connection, 24; with container, 19, connected to the intermediate compressor stage outlet, 7, via the changeable gas flow connection, 25; with container, 20, connected to the high pressure compressor stage outlet, 8, via the changeable gas flow connection, 26; with container, 21, connected to the high pressure expander stage inlet, 14, via the changeable gas flow connection, 27; with container 22, connected to the intermediate pressure expander stage inlet, 15, via the changeable gas flow connection, 28; with container, 23, connected to the low pressure expander stage inlet, 16, via the changeable gas flow connection, 29. As described in the material incorporated herein by reference, the connections between containers and compressor stage outlets and expander stage inlets shown in FIG. 2 will prevail for only one time period of a sequence of time periods which is repeated. Each container is connected in turn, by changing the changeable gas flow connections, to the low pressure compressor stage outlet, then to the intermediate pressure compressor stage outlet, then to the high pressure expander stage inlet, then to the intermediate pressure expander stage inlet, then to the low pressure expander stage inlet, in that order and this sequences is then repeated for each container in turn. In some cases a number of containers may be used greater than the sum of the number of compressor stages plus the number of expander stages so that removal of spent solid reactant and replacement with fresh solid reactant can be carried out on each container when not connected to either the compressor or expander. In this latter case the sequence for each container will also comprise time periods for this removal and replacement of solid reactant. In all cases the number of containers is to al least equal the sum of the number of compressor stages plus the number of expander stages.

5. The total number of changeable gas flow connections equals the product of the number of containers times the sum of the number of compressor stages plus the number of expander stages. Any one container has a number of changeable gas connections equal to the sum of the number of compressor stages plus the number of expander stages and these are shown for the one container, 21, in FIG. 1. Container, 21, carries out a sequence of connections to compressor outlets and then expander inlets as follows:

a. With all other changeable gas flow connections closed, changeable gas flow connection, 44, is opened and container, 21, is connected for a first time period to the outlet, 6, of the low pressure compressor stage, 2.

b. Changeable gas flow connection, 44, is closed at the end of the first time period while changeable gas flow connection, 45, is opened and container, 21, is connected for a second time period to the outlet, 7, of the intermediate pressure compressor stage, 3.

c. Changeable gas flow connection, 45 is closed at the end of the second time period while changeable gas flow connection, 46, is opened and container, 21, is connected for a third time period to the outlet, 8, of the high pressure compressor stage, 4.

d. Changeable gas flow connection. 46, is closed at the end of the third time period while changeable gas flow connection, 27, is opened and container, 21, is connected to the inlet, 14, of the high pressure expander stage, 10, for a fourth time period.

e. Changeable gas flow connection, 27, is closed at the end of the fourth time period while changeable gas flow connection, 47, is opened and container, 21, is connected to the inlet, 15, of the intermediate pressure expander stage, 11, for a fifth time period.

f. Changeable gas flow connection, 47, is closed at the end of the fifth time period while changeable gas flow connection, 48, is opened and container, 21, is connected to the inlet, 16, of the low pressure expander stage, 12, for a sixth time period. This completes one sequence of connections for container, 21, and this sequence is then repeated.

g. In those changeable gas flow connections from compressor outlets to containers the gas always flows only in the direction from the compressor to the container. In those changeable gas flow connections from containers to expander inlets the gas always flows from the container to the expander. Thus in each changeable gas flow connection the gas flow direction is always the same.

Each container has similar separate changeable gas flow connections and carries out the same sequence of connections to compressor outlets and expander inlets and in the order container, 21, followed by container, 20, followed by container, 19, followed by container, 18, followed by container, 23, followed by container, 22. In this manner each container is first compressed up to a peak pressure and then expanded down to a minimum pressure and this cycle of compression followed by expansion is repeated.

B. Separate means for holding steady the discharge pressure from each stage of the compressor, 1, comprises tanks, 50, 51, 52, and means for regulating back pressure of flowing gas, 53, 54, 55, each outlet, 6, 7, 8 of each compressor stage, 2, 3, 4 being thusly equipped. The compressor stage outlets, 6,7,8, connect to the tank inlets, 56, 57, 58, the tank outlets, 59, 60, 61, connect to the back pressure regulator inlets, 62, 63, 64, and the back pressure regulator outlets, 65, 66, 67, connect to those changeable gas flow connections, 24, 25, 26, 44, 45, 46, etc., which receive compressed gas from the compressor stage outlets, 6, 7, 8. With these means for interconnecting the means for regulating back pressures, 53, 54, 55, act to hold steady the discharge gas pressure in the tanks, 50. 51, 52, and hence also at the compressor stage outlets, 6, 7, 8. All gas flowing from compressor stage outlets, 6, 7, 8, to containers, 18, 19, 20, etc., flows through these means for holding steady discharge pressure.

C. Separate means for holding steady the inlet pressure to each stage of the expander, 9, comprising tanks, 68, 69, 70, and means for regulating downstream pressure of flowing gas, 71, 72, 73, each inlet, 14, 15, 16, of each expander stage, 10, 11, 12, being thusly equipped. The expander stage inlets, 14, 15, 16, connect to the tank outlets, 74, 75, 76, the tank inlets, 77, 78, 79, connect to the downstream pressure regulator outlets, 80, 81, 82, and the downstream pressure regulator inlets, 83. 84, 85, connect to those changeable gas flow connections, 27, 28, 29, 47, 48, etc., which deliver reacted gas from the containers to the expander stage inlets, 14, 15, 16. with these interconnection means the means for regulating downstream pressure, 71, 72, 73, act to hold steady the reacted gas pressure in the tanks, 68, 69, 70, and hence also at the expander stage inlets, 14, 15, 16. All gas flowing from containers 21, 22, 23, etc., to expander stage inlets, 14, 15, 16, flows through these means for holding steady inlet pressure.

The back pressure regulating means, 53, 54, 55, and the downstream pressure regulating means, 71, 72, 73, can be any of the various kinds of pressure regulating valves already well known in the prior art.

The steady work output apparatus on the cyclic gas with solid reaction plant shown in the example of FIG. 1 and FIG. 2 thus functions to hold steady the pressures at each compressor stage outlet and also the pressures at each expander stage inlet. Hence the work output rate of each expander stage is constant, and the work input rate of each compressor stage is constant, and in consequence the net work rate of the cyclic gas with solid reaction plant is also constant. This is one of the beneficial objects of this invention.

In the cyclic gas with solid reaction plants described herein above in the prior art a single fixed open gas flow connection enters each container and the several changeable gas flow connections connect into this. The steady work output rate apparatus of this invention can readily be used with these prior art forms of cyclic gas with solid reaction plants. Alternatively in some applications it may be preferable to additionally modify the means of connecting between the changeable gas flow connections and the containers so that the changeable gas flow connections from compressor stage outlets connect to the container at places different from those connected into the container by changeable gas flow connections to expander stage inlets.

In some forms of this invention each of these separate changeable gas flow connections from compressor outlets to each container may connect at two or more different places into the container.

In the operation of a cyclic gas with solid reactor of this invention using thusly modified container connections reactant gas is compressed during compression into the solid reactant within the reaction chamber inside the container and first into that particular portion of solid reactant adjacent to where the changeable gas flow connections from compressor outlets connect into the container. Subsequently, during expansion reacted gas flows first out of those particular solid reactant portions adjacent to where the changeable gas flow connections to expander inlets connect into the container. Thus within each changeable gas flow connection the gas flow direction is always the same. In consequence the reactant gas flows into the solid reactant pores in one flow pattern and the reacted gas flows out of the solid reactant pores in another flow pattern which differs from the inflow pattern. Hence also gas flows across the solid reactant within its reaction chamber in order to change from the inflow pattern to the outflow pattern. The additional beneficial objects of this form of the invention result from one or more of the following effects:

1. During compression reactant gas is directed first into particular portions of the solid reactant.
2. During expansion reacted gas is removed first from different particular portions of the solid reactant.
3. The gases flow across portions of the solid reactant during each cycle of compression followed by expansion.

Figure 3:
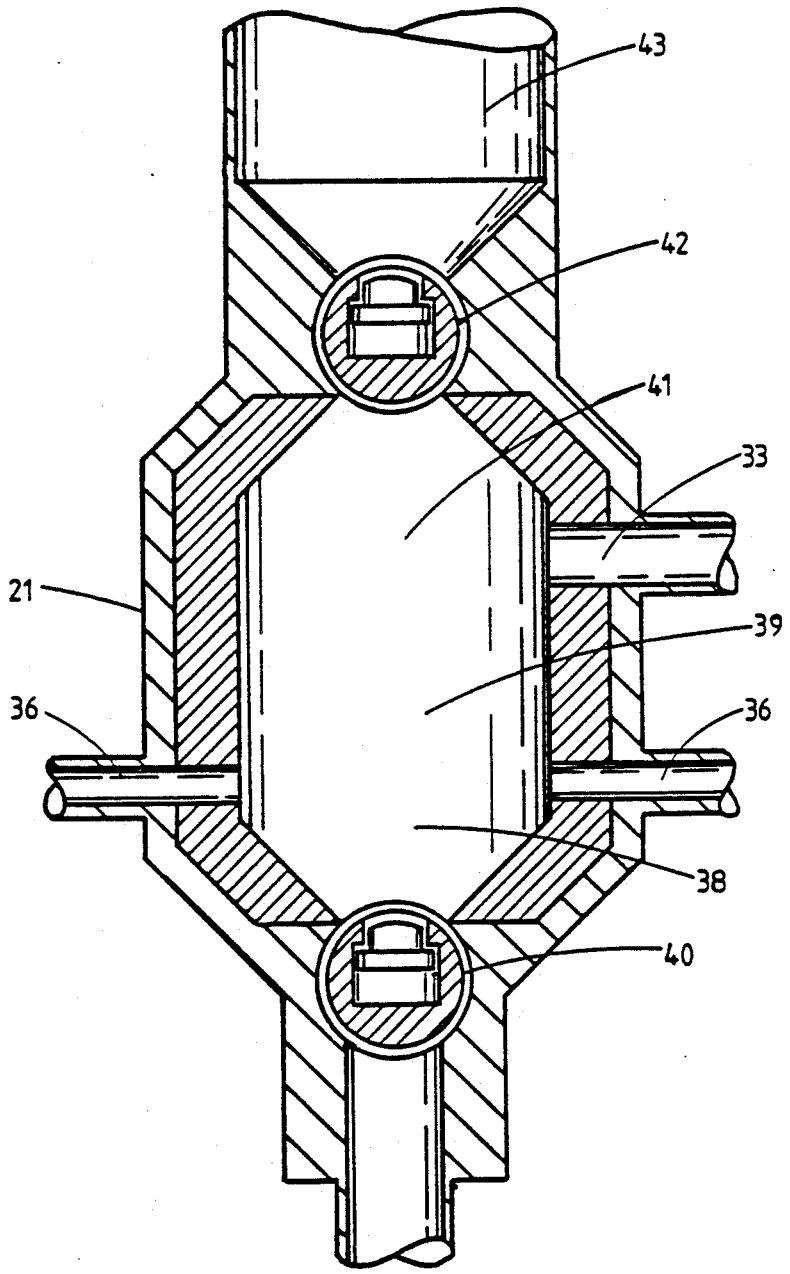

One example of a cyclic gas with solid reaction plant of this invention and further utilizing these modified container connections is shown schematically in FIGS. 1, 2, and 3. The changeable gas flow connections, 24, 25, 26 from compressor outlets, 6, 7, 8, connect to the containers, 18, 19, 20, at places thereon, 30, 31, 32, which are different from the places, 33, 34, 35, where the changeable gas flow connections, 27, 28, 29, to expander inlets, 14, 15, 16, connect to the containers, 21, 22, 23. These different places of connection into containers are shown in more detail in FIG. 3 for one particular container, 21, with compressor outlet connections, 36, being located near the bottom, 38, of the container where the spent solid reactant is about to be removed therefrom by the removal mechanism, 40. Expander inlet connections, 33, are located near the top, 41, of the container where the fresh solid reactant is added by the refuel mechanism, 42, from the hopper supply, 43.

During each compression reactant gas is compressed into the pore spaces of the solid reactant inside the container, 21, and enters first at the compressor connections, 36. In this way the fresh reactant gas first contacts that spent solid reactant which is about to be removed from the reaction chamber and more complete reaction of this solid reactant prior to removal can be obtained. This is one of the beneficial objects of this form of the invention. For example, in a cyclic char gasifier of U.S. Pat. No. 4,509,957, we which the char fuel to be completely gassified by air until only ashes remain to be removed and this result can be better achieved by directing the incoming fresh reactant air into the ash removal end, 38, of the container as shown in FIG. 3.

Also during each compression reactant gas flows upward through the container from the compressor connections, 36, at the bottom end, 38, in order to reach into all solid pore spaces within the container.

During each expansion reacted gas flows out of the pore spaces of the solid reactant inside the container, 21, and eaves the container via the expander connection, 33. In this way reacted gas flows upward through the container toward the expander connection, 33, during expansion as the reacted gas leaves the pore spaces of the solid reactant. Where the gas-with-solid reaction is exothermic these reacted gases will be much hotter than the original reactant gases and also the fresh solid reactant. This upward flow of hot reacted gas acts to heat up the fresh incoming solid reactant entering the upper end, 41, of the container via the refuel mechanism, 42, and thus to speed up the gas-with-solid reaction process. This is another of the beneficial objects of this form of the invention, that the fresh solid reactant can be readily preheated up to a rapid reaction temperature.

With certain gas-with-solid reactions the solid reactant is very nearly completely gasified and only unreactable ashes remain to be removed. In these cases the ash particle size will be much smaller than the original solid reactant chunk. These small ash particles may carryover into the expander, where undesirable deposition or mechanical damage may occur, if reacted gas outflow from the container takes place near the ash removal end of the container. With the modified gas flow connections of this form of the invention, reacted gas outflow takes place from the refuel end of the container where solid reactant size is largest. Additionally reacted gas flows through the solid reactant material from the ash removal end toward the refuel end and any ash particles tending to carry over will be filtered out of the reacted gas by this bed of solid reactant. The reacted gas outflow connection, 33, can be screened or made sufficiently smaller than the solid reactant chunks to prevent these chunks being carried over. This is another of the beneficial objects of this form of the invention, that small ash particle carryover into the expander can be avoided.

In some applications of cyclic solid with gas reaction plants it may be desired to introduce fresh reactant gas also near the refuel end of the container. for example in a cyclic velox boiler of U.S. Pat. No. 4,455,837, the reacted gases formed from the gas-with-solid reaction within the primary reaction chamber of the solid reactant fuel bed are subsequently reacted further with additional reactant gas in the secondary reaction chamber above the solid fuel bed within the same container. Hence additional fresh reactant gas is needed at the refuel end of the container for this secondary reaction. Thus for certain cyclic gas with solid reaction plants we may prefer that the changeable gas flow connections from compressor outlets connect into each container at least two different places.

Having thus described my invention what I claim is:

1. In a cyclic gas with solid reaction plant comprising a separate compressor means comprising at least one stage; drive means for driving said compressor; a separate expander means comprising at least one stage; a number of containers at least equal to the sum of the number of compressor stages plus the number of expander stages, each said container comprising at least one reaction chamber; each compressor stage comprising an outlet pipe for gases being compressed therein; each expander stage comprising an inlet pipe for reacted gases to be expanded therein; separate changeable gas flow connections between each said container and each said outlet of each said compressor stage and each said inlet of each said expander stage;

wherein the improvement comprises:

a number of separate means for holding steady the discharge pressure from the outlet of each said compressor stage of said cyclic gas with solid reaction plant, said number of separate means for holding discharge pressure steady being equal to the number of said compressor stages, each said means for holding steady discharge pressure comprising:

tank means for containing gas at high pressure comprising a tank inlet and a tank outlet;

means for regulating back pressure of flowing gas comprising a back pressure regulator inlet and a back pressure regulator outlet;

fixed open gas flow connections from said tank means outlet to said back pressure regulator inlet of said means for regulating back pressure;

several means for interconnecting one of said means for holding steady discharge pressure between the outlet pipe of one stage of said compressor and those changeable gas flow connections to which that one compressor stage delivers compressed gas, so that all compressed gas from that one compressor stage flows first into said tank means for containing, second into said means for regulating back pressure and third to that changeable gas flow connection which is currently open, each said compressor stage being thusly fitted with one of said means for interconnecting and said means for holding steady discharge pressure;

said means for interconnecting comprising: a fixed open gas flow connection form said compressor outlet to said tank inlet; a fixed open gas flow connection from said back pressure regulator outlet to said changeable gas flow connections to which that one compressor stage delivers compressed gas;

a number of separate means for holding steady the inlet pressure to the inlet of each said expander stage of said cyclic gas with solid reaction plant, said number of separate means for holding inlet pressure steady being equal to the number of said expander stages, each said means for holding steady inlet pressure comprising:

tank means for containing gas at high pressure comprising a tank inlet and a tank outlet;

means for regulating downstream pressure of flowing gas comprising a downstream pressure regulator inlet and a downstream pressure regulator outlet;

fixed open gas flow connection from said downstream pressure regulator outlet to said tank means inlet;

several means for interconnecting one of said means for holding steady inlet pressure between the inlet pipe of one stage of said expander and those changeable gas flow connections from which that one expander stage receives reacted gas, so that all reacted gas going to that one expander stage flows first from that changeable gas flow connection which is currently open, second into said means for regulating downstream pressure, third into said tank means for containing, and fourth into said inlet pipe of said one expander stage, each said expander stage being thusly fitted with one of said means for interconnecting and said means for holding steady inlet pressure;

said means for interconnecting comprising: a fixed open gas flow connection from said expander inlet to a said tank outlet; a fixed open gas flow connection form said downstream pressure regulator inlet to said changeable gas flow connections from which that one expander stage receives reacted gas.

2. A cyclic gas with solid reaction plant as described in claim 1 wherein:

said separate changeable gas flow connections operative between each said compressor stage outlet and each said container connect into said container at places different from those connected into by said separate changeable gas flow connections operative between each said expander stage inlet and each said container.

3. A cyclic gas with solid reaction plant as described in claim 2 wherein:

said separate changeable gas flow connections operative between each said compressor stage outlet and each said container connect into each said container at least two different places.

* * * * *

UNITED STATES PATENT AND TRADEMARK OFFICE

CERTIFICATE OF CORRECTION

PATENT NO. : 4,889,539

DATED : December 26, 1989

INVENTOR(S) : Joseph C. Firey

It is certified that error appears in the above-identified patent and that said Letters Patent is hereby corrected as shown below:

Abstract, line 1: delete, "values," and insert, -- valves --.

Abstract, line 7: delete, "thee," and insert, -- these --.

Abstract, line 7: delete, "values," and insert, -- valves --.

Abstract, line 16: delete, "soaid," and insert, -- solid --.

Column 1, line 16: delete, "07/2360," and insert, -- 07/275360 --.

Column 7, add between line 27 and line 28: -- sure compressor stage outlet, then to the high pres ---.

Column 7, line 42: delete, "al," and insert, -- at --.

Column 10, line 46: delete, "which," and insert, -- wish --.

Column 11, add another, -- at --, between lines 46 and 47.

UNITED STATES PATENT AND TRADEMARK OFFICE

CERTIFICATE OF CORRECTION

PATENT NO. : 4,889,539

DATED : December 26, 1989

INVENTOR(S) : Joseph C. Firey

It is certified that error appears in the above-identified patent and that said Letters Patent is hereby corrected as shown below:

Column 12, line 26: delete, "form," and insert, --from--.

Column 12, line 67: delete, "form," and insert, --from--.

Signed and Sealed this

Twentieth Day of November, 1990

*Attest:*

HARRY F. MANBECK, JR.

*Attesting Officer*

*Commissioner of Patents and Trademarks*